United States Patent [19]

Krober

[11] Patent Number: 4,953,462

[45] Date of Patent: Sep. 4, 1990

[54] BEARING FOR ROTARY PRESS CYLINDERS

[75] Inventor: Ulrich Krober, Offenbach am Main, Fed. Rep. of Germany

[73] Assignee: Man Roland Druckmaschinen AG, Fed. Rep. of Germany

[21] Appl. No.: 311,724

[22] Filed: Feb. 16, 1989

[30] Foreign Application Priority Data

Feb. 19, 1988 [DE] Fed. Rep. of Germany ..... 3805143

[51] Int. Cl.[5] ..... B41F 13/20; B41F 13/28; B41F 31/34

[52] U.S. Cl. ..... 101/216; 101/348

[58] Field of Search ..... 101/348, 349, 350, 351, 101/352, 363, 207, 208–210, 148, 212, 216, 219; 384/247, 255, 256; 29/110, 116.1

[56] References Cited

U.S. PATENT DOCUMENTS 1,816,948 8/1931 Wood ..... 101/348

FOREIGN PATENT DOCUMENTS 1242636 6/1967 Fed. Rep. of Germany .
1268443 5/1968 Fed. Rep. of Germany .
1995046 6/1968 Fed. Rep. of Germany .
3004921 10/1981 Fed. Rep. of Germany .
238358 8/1986 German Democratic Rep. ..... 101/348

*Primary Examiner*—J. Reed Fisher
*Attorney, Agent, or Firm*—Leydig, Voit & Mayer

[57] ABSTRACT

An adjustable bearing arrangement for the cylinder of a rotary printing press provides a fine adjustment in which a step-down in the angle of rotation of the adjusting movement of an eccentric bushing relative to the rotation of a radially slotted cylinder mounting bracket is ensured. The locating pin of the cylinder mounting is rotatably mounted in the eccentric bushing and rotation-inhibiting means for the pin is formed by a groove in which one end of a rotation-inhibiting lever is guided after the fashion of a prismatic joint, the other end of the lever being so mounted fixedly to the frame that the lever can pivot around a knuckle joint disposed parallel to the pin. The anti-friction bearings of the cylinder are disposed on the journal of the cylinder with their outer race received in a totally enclosed bearing ring having a guide pin beveled to form two flat sides, the guide pin being introduced into a slot S of the cylinder mounting and being locked therein by a spring biased detent.

4 Claims, 2 Drawing Sheets

FIG. 1
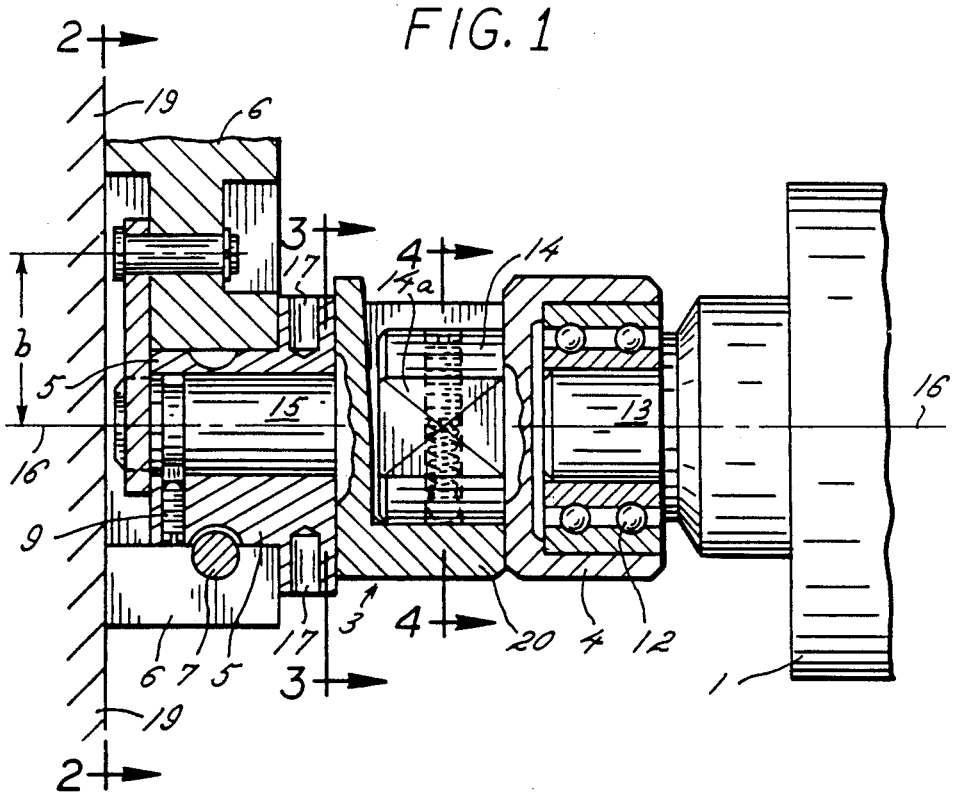
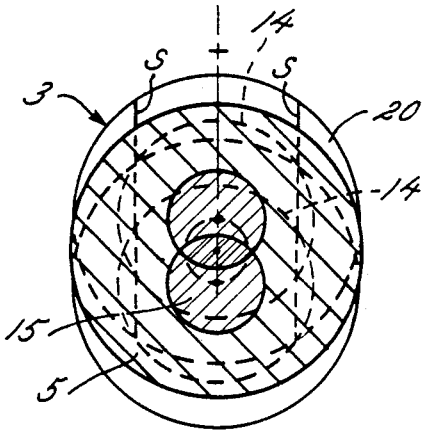
FIG. 3a
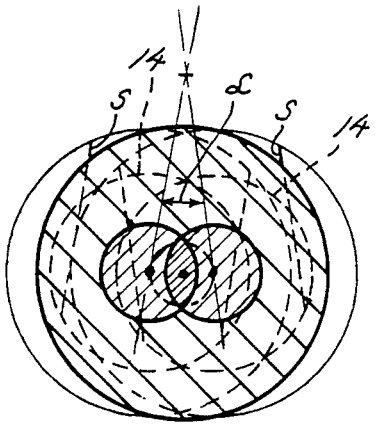
FIG. 3b

BEARING FOR ROTARY PRESS CYLINDERS

FIELD OF THE INVENTION

The present invention relates generally to an adjustable bearing arrangement for the cylinder of a rotary printing press, and more particularly concerns an improved eccentric mounting for such bearings.

BACKGROUND OF THE INVENTION

Various arrangements for mounting the bearings journalling the cylinders of rotary printing presses are known in the prior art. A cylinder bearing of this general kind is known from DE-Gbm 1,995,046 wherein the cylinder mounting includes a shouldered pin in a closed bearing with a journal being mounted on the pin for axial insertion into the bearing liner. These bearings are difficult to control during installation since they require two-man control or additional facilities to hold the cylinder when the journal is introduced axially into the bearing liner. In another known construction, see for example DE PS 1,242,636, two applicator cylinders are disposed in pivoted levers for pivoting around a friction cylinder. The axial distance between the applicator cylinders and the friction cylinder in this case is also adjusted by means of eccentrics which are disposed on the friction cylinder shaft.

It is also known from DE-AS 1,268,443 to provide an eccentric and stationary mounting on the frame, by way of the journal, of a bearing member open on one side. However, since the bearing member and the eccentric journal are a unitary member, when the mounted cylinder is required to be adjusted relatively to another cylinder by a simple rotation of the eccentric, the assembly or demounting member rotates through the same angle of rotation. This is unsatisfactory when cylinders have to be accessible from only one side and in an assembly and demounting direction which remains substantially constant because all the other sides are concealed by inking or damping unit cylinders or by other parts of the press.

OBJECTS AND SUMMARY OF THE INVENTION

It is therefore the primary aim of the invention to provide a device of the kind hereinbefore set out in which the angle of rotation of the adjustable eccentric bushing or bearing liner is accompanied by a substantial step-down in the rotation of the cylinder mounting bracket.

This is accomplished according to the present invention by inserting an axial locating pin of the bearing support bracket in an eccentric bushing carried in the press frame and providing rotation-inhibiting means for the locating pin. In the preferred embodiment, the rotation-inhibiting means includes a vertical groove formed in the end face of the locating pin dimensioned to receive and guide one end of a rotation-inhibiting lever, the other end of which is pivoted to the press frame by a knuckle joint disposed parallel to the locating pin. The outer race of the anti-friction bearings for the cylinder is carried in a closed bearing ring having an axial support pin with flat vertical sides dimensioned to be received in a vertical slot of the bearing support bracket. The support pin is rotatable in the support bracket to move the flat sides out of registry with the slot opening and a spring biased detent is provided for retaining the support pin in the support bracket. A clamp bolt is provided to clamp the eccentric bushing in the desired position in the press frame and to prevent axial shifting with respect thereto. Also the locating pin is formed with a circumferential recess engageable by a radial retaining pin in the eccentric bushing to prevent axial shifting of the pin relative to the bushing.

The cylinder bearing arrangement according to the invention has advantages in service and also ensures that the direction of the slot in the mounting bracket remains substantially the same during adjustment of the eccentric bushing for the cylinder. Thus the cylinder can be conveniently installed or removed when necessary.

These and other features and advantages of the invention will be more readily apparent upon reading the following description of a preferred exemplified embodiment of the invention and upon reference to the accompanying drawings wherein:

BRIEF DESCRIPTION OF THE DRAWINGS

FIG. 1 is a side elevation, partially in vertical section of the improved adjustable eccentric bearing arrangement of the present invention;

FIGS. 3*a* and 3*b* are vertical cross sections taken substantially through the eccentric bearing along line 3—3 in FIG. 1 showing the orientation of the slot in the mounting bracket as the eccentric is rotated between its extreme vertical positions (FIG. 3*a*) and its extreme lateral positions (FIG. 3*b*); and, FIGS. 4*a* and 4*b* are vertical cross sections taken through the supporting pin and supporting bracket along line 4—4 in FIG. 1 showing the orientation of the supporting pin during installation and removal (FIG. 4*a*) and when locked in position in the supporting bracket (FIG. 4*b*).

While the invention will be described and disclosed in connection with certain preferred embodiments and procedures, it is not intended to limit the invention to those specific embodiments. Rather it is intended to cover all such alternative embodiments and modifications as fall within the spirit and scope of the invention.

DETAILED DESCRIPTION OF THE PREFERRED EMBODIMENTS

Figure 4B:
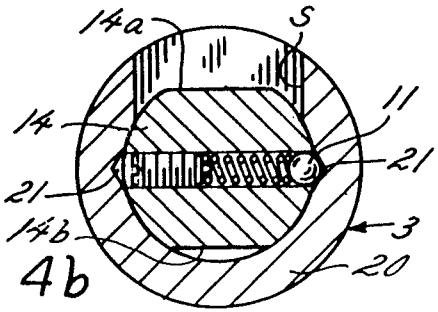
Figure 4A:
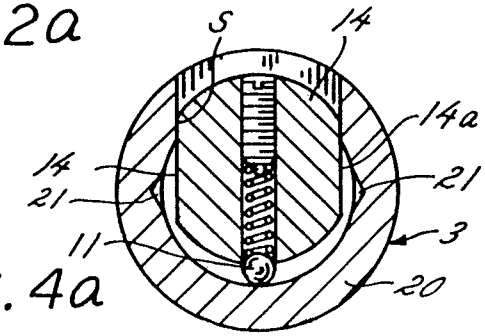

Turning now to the drawings, there is shown in FIG. 1 a cylinder 1 of a rotary printing press having an upright mounting frame 19. The cylinder 1 includes a spindle end 13 journalled in an anti-friction ball or roller bearing 12, the outer race of which is carried in an enclosed bearing support ring 4 from which a generally round supporting pin 14 projects substantially axially. The supporting pin 14 is formed with substantially flat vertical side faces 14*a* and 14*b* dimensioned to be received in a radially opening slot S in the supporting stirrup portion 20 of a mounting bracket 3. (See FIG. 4*a*).

In accordance with the adjustable bearing arrangement of the present invention, the mounting bracket 3 includes a substantially axially extending locating pin 15 rotatably mounted in an eccentric bushing or bearing liner 5 rotatably disposed in a circular aperture of a bearing bracket 6 secured to the side upright 19 of the printing press frame. Thus, it will be seen in FIG. 1 that the cylinder spindle 13, the supporting pin 14 of the ring 4 and the locating pin 15 of the mounting bracket 3 are all disposed in alignment with one another and with the axis 16 of the cylinder 1 —— i.e., they are arranged coaxially. It will also be understood that the anti-friction bearing 12, the bearing outer race support ring 4 and the supporting stirrup 20 of the bracket 3 are also arranged coaxially with the cylinder axis 16.

During installation or removal of the cylinder 1, the supporting pin 14 of the ring 4 is oriented so that the flat sides 14*a*, 14*b* are substantially vertical for insertion into the substantially vertically disposed radially open slot S in the supporting stirrup 20 of the mounting bracket 3. After the pin 14 has been installed in the central bore of the stirrup 20 the ring 4 is turned to the right or the left, for example approximately 90° (see FIG. 4*b*). The generally round part of the pin 14 therefore turns in the central bore of the stirrup 20 until a resilient thrust or pressure element 11 carried in the pin 14 engages an internal detent recess 21 in the bore of the stirrup 20. The supporting pin 14 is then locked in place and secured against rotation relative to the supporting stirrup 20.

In the illustrated embodiment the locating pin 15 is mounted in a bracket 6 secured to the press frame 19. If desired, however, the locating pin 15 can be mounted directly in the upright frame 19 of the press. Alternatively, if the cylinder 1 is also required to be pivoted into and out of engagement with a companion cylinder 2, the locating pin 15 can be mounted in a corresponding lever (not shown) pivoted to the press upright 19.

Figure 2B:
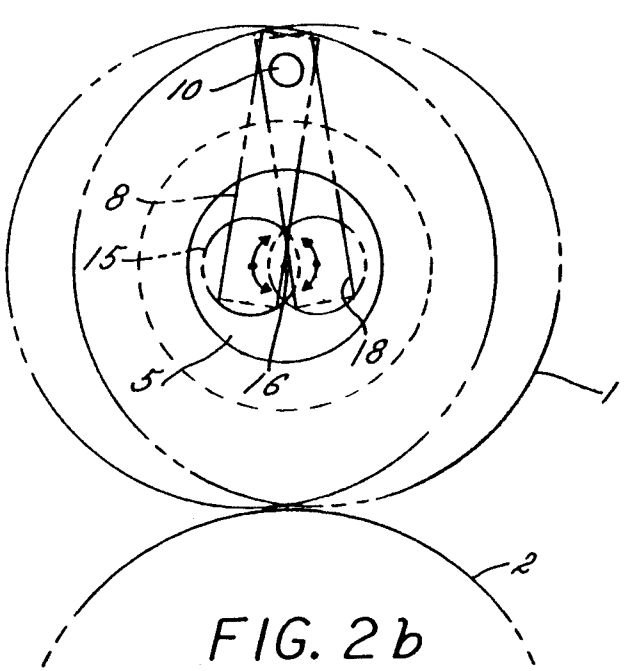
FIG. 2*b* is a simplified fragmentary end view similar to FIG. 2*a* showing the extreme lateral positions of the locating pin as the eccentric bushing is rotated.
Figure 2A:
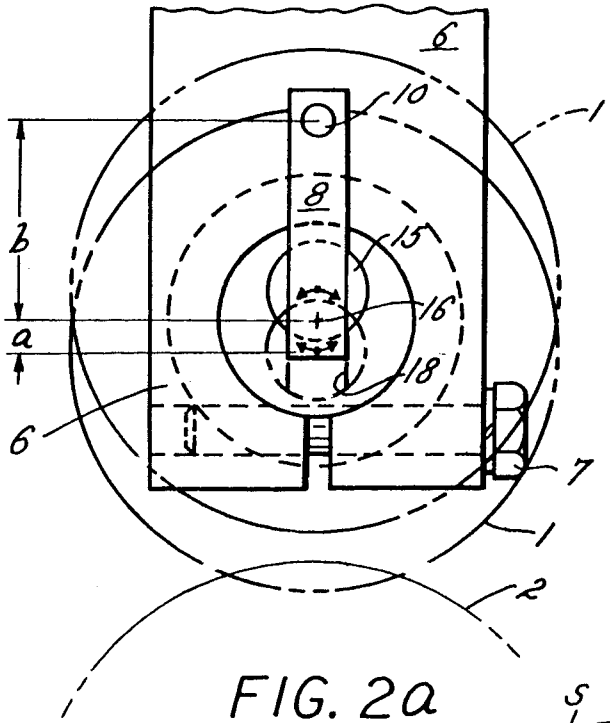
FIG. 2*a* is a fragmentary end view substantially as seen along line 2—2 in FIG. 1 showing the extreme vertical positions of the locating pin as the eccentric bushing is rotated.

As shown in FIG. 2*a*, the opening in the bracket 6 which receives the eccentric bushing or bearing liner 5 is formed with a narrow slot so that the eccentric bushing 5 can be selectively clamped in position by means of a clamping bolt or screw 7 which also secures the bushing 5 against axial displacement relative to the frame bracket 6. Also to prevent the locating pin 15 from shifting axially in the bushing 5, an annular recess is formed in the external surface of the pin 5 and is engaged by the inner tip of a retaining pin 9 screwed radially into a threaded hole in the bushing 5 (see FIG. 1).

To shift the cylinder 1 with respect to a companion cylinder 2 (as seen in FIGS. 2*a* and 2*b*), the locking bolt 7 is first loosened to unclamp the eccentric bushing 5 for rotation in the frame bracket 6. The eccentric 5 can then be turned by means of a key or special tool engaging the radial bores 17 disposed in the periphery of the eccentric bushing.

In accordance with the present invention, the locating pin 15 is prevented from any substantial amount of turning as the eccentric bushing is rotatably adjusted. To this end, the locating pin 15 of the mounting 3 is formed on its end face with a shallow and generally square-cut groove 18 disposed substantially parallel to the radially opening slot S in the supporting stirrup 20. One end of a rotation-inhibiting lever 8 is received and guided in the groove 18, much in the fashion of a prismatic joint, in this case with the side faces generally parallel to a vertical axis and parallel to the sides of the slot S.

As shown in FIG. 2*a*, the rotation-inhibiting lever 8 may be formed in the shape of a flat metal member or strap and is dimensioned for a close but freely sliding fit in the end groove 18 of the locating pin 15. The lever 8 has its other end mounted by means of a pivot pin or knuckle joint 10 on the frame bracket 6 so that it can pivot slightly around the pin 10 parallel to the locating pin 15.

When the eccentric bushing 5 is rotated through 90° to the left or right (see FIGS. 2*b* and 3*b* ), the lever 8 inhibits the rotation of the locating pin 15 and thus the supporting stirrup 20 and its radial slot S so that the slot S turns by only a reduced amount corresponding to half the angle $\alpha$. It will be understood that the amount of this rotation is determined by the ratio of the eccentricity a of the bushing 5 to the distance b between the pivot pin 10 and the central axis of the bore of the bushing 5 where $\alpha = \tan \alpha$. In the worst case, the installation and removal slot S in the supporting stirrup is rotated through the angle $\alpha$, corresponding to a rotation of the bushing 5 through 180°, for example, from left to right in a lateral direction as shown by the extreme positions in FIGS. 2*b* and 3*b*.

Pursuant to the present invention, therefore, the adjustable bearing arrangement permits fine adjustment of the cylinder 1 relative to a companion cylinder 2 with a very reduced rotational movement of the slot S through which the cylinder 1 is installed and removed. Also with the shaft 14 of the ring 4 properly locked in the stirrup 20 of the bracket 3 by the spring detent 11, the cylinder 1 is journalled reliably, accurately and substantially without wear in the anti-friction bearing 12 of the eccentric mounting arrangement. Installation and removal of the cylinder 1 from the adjustable bearing arrangement of the present invention are also made more convenient since the amount of rotation of the mounting slot S is minimized in comparison to the amount of rotation provided and permitted for the eccentric bushings when the cylinder is adjusted.

In view of the foregoing and from a transmission point of view, the rotation-inhibiting means according to the present invention and comprising components 3, 5, 6, 8, 10 and 18 might be regarded as being like the movement pattern of an oscillating slider crank having an altered prismatic joint form 18 wherein the eccentric bushing 5 represents a special form of a crank clampable in the side upright 19 of the press.

I claim as my invention:

1. An adjustable bearing arrangement for mounting the spindle end of a rotary printing press cylinder, comprising: a press frame, an eccentric bushing rotatably mounted in an aperture in the press frame, clamping means for selectively locking said bushing in position in said frame aperture, a cylinder mounting bracket having a substantially axially extending locating pin rotatably received coaxially in said eccentric bushing, and an anti-friction bearing carried by said mounting bracket coaxially with said locating pin for journalling said cylinder spindle, rotation-inhibiting means for locking said locating pin in an operative position including a rotation-inhibiting lever, a substantially vertical groove formed in the end of said locating pin for receiving and guiding one end of said rotation-inhibiting lever, a knuckle joint disposed parallel to said locating pin, the other end of said lever being pivotally mounted on said press frame around said knuckle joint, said anti-friction bearing including an outer race disposed in an enclosed bearing support ring having a coaxially extending, generally round support pin formed with two substantially vertical and flat outer faces, said cylinder mounting bracket having a bearing support member for receiving said support pin and formed with an open radial slot on one side thereof aligned with said vertical groove in said locating pin and dimensioned to receive said flat outer faces of said support pin therebetween, and said support pin being rotatable within said support member so that said flat outer faces are out of registry with said slot and said support pin is retained in said support member.

2. An adjustable bearing arrangement as defined in claim 1 including a resilient pressure member disposed in said support pin of said bearing support ring, and said bearing support member having an internal detent recess for receiving said resilient pressure member and locking said support pin in position upon rotation within said support member.

3. An adjustable bearing arrangement as defined in claim 1 wherein said clamping means includes a locking bolt carried by said press frame and disposed substantially tangentially to said eccentric bushing, said locking bolt being partially received in a circumferential groove formed in the outer surface of said bushing so as to prevent axial shifting of said bushing in said frame aperture while said locking bolt is in position.

4. An adjustable bearing arrangement as defined in claim 1 wherein said locating pin is formed with a circumferential recess in the outer surface thereof and said eccentric bushing is formed with a radially extending opening for receiving a retaining pin therein the inner end of which is engageable with said circumferential recess so as to prevent axial shifting of said locating pin in said eccentric bushing when said retaining pin is in place.

* * * * *